US008012330B2

(12) United States Patent
Kawakami et al.

(10) Patent No.: US 8,012,330 B2
(45) Date of Patent: Sep. 6, 2011

(54) PLATING METHOD AND PLATING APPARATUS

(75) Inventors: Takashi Kawakami, Kanagawa-ken (JP); Tsutomu Nakada, Tokyo (JP)

(73) Assignee: Ebara Corporation, Tokyo (JP)

( * ) Notice: Subject to any disclaimer, the term of this patent is extended or adjusted under 35 U.S.C. 154(b) by 814 days.

(21) Appl. No.: 12/071,679

(22) Filed: Feb. 25, 2008

(65) Prior Publication Data

US 2008/0210562 A1 Sep. 4, 2008

(30) Foreign Application Priority Data

Feb. 26, 2007 (JP) ..... 2007-046187

(51) Int. Cl.

| | |
|---|---|
| ***C25D 5/00*** | (2006.01) |
| ***C25D 5/02*** | (2006.01) |
| ***C25D 7/12*** | (2006.01) |
| ***C25D 5/20*** | (2006.01) |
| ***B23H 11/00*** | (2006.01) |

(52) U.S. Cl. ..... 205/96; 205/123; 205/137; 205/148; 205/157; 204/225; 204/275.1; 134/902

(58) Field of Classification Search ..... 205/50–333; 204/225, 198–297.16; 134/902
See application file for complete search history.

(56) References Cited

U.S. PATENT DOCUMENTS

2004/0182712 A1* 9/2004 Basol ..... 205/98
2005/0023149 A1 2/2005 Nakada et al.

* cited by examiner

*Primary Examiner* — Alexa Neckel
*Assistant Examiner* — Brian Cohen
(74) *Attorney, Agent, or Firm* — Wenderoth, Lind & Ponack, L.L.P.

(57) ABSTRACT

A plating method, employing a face-down manner of plating and using a resistor body between a substrate and an anode, can securely bring an entire surface to be plated of the substrate into contact with a plating solution without permitting intrusion of air bubbles to the surface to be plated. A resistor body is disposed above the anode and immersed in the plating solution, allowing the plating solution to flow along an upper surface of the resistor body from the periphery toward the center of the resistor body. Thus, a raised portion of the plating solution is created in the center of the upper surface of the resistor body. The substrate is then lowered with the surface facing downwardly so as to fill the space between the surface to be plated of the substrate and the upper surface of the resistor body with the plating solution.

6 Claims, 15 Drawing Sheets

PLATING METHOD AND PLATING APPARATUS

Cross-reference to related application. This application is based upon and claims the benefit of priority from the prior Japanese Patent Application No. 2007-046187 filed Feb. 26, 2007, the entire contents of which are incorporated herein by reference.

BACKGROUND OF THE INVENTION

1. Field of the Invention

The present invention relates to a plating method and a plating apparatus which can be advantageously used for supplying a plating solution to a surface to be plated of a substrate, such as a semiconductor substrate, and forming, e.g., a circuit pattern of interconnects in the surface to be plated of the substrate.

2. Description of the Related Art

A plating apparatus has been known which processes a surface to be plated of a substrate with the surface to be plated facing downwardly (face down) (see, for example, Japanese Patent Laid-Open Publication No. 2005-2455). This plating apparatus uses a resistor body (impregnation member) provided between a substrate and an anode in order to carry out uniform plating of the surface to be plated of the substrate.

When carrying out plating of a substrate in a face-down manner, the substrate is lowered from above a plating solution held in a plating cell so as to bring the surface to be plated of the substrate into contact with the plating solution. When the substrate is lowered while keeping the surface to be plated parallel to a surface of the plating solution, air bubbles may intrude into the interface between the substrate and the plating solution. This causes the problem that there will be non-contact portions of the surface to be plated with the plating solution due to the presence of the air bubbles, resulting in non-uniform plating of the surface to be plated of the substrate. The provision of a resistor body between a substrate and an anode involves the problem that the resistor body produces heat when applying current on plating, causing a rise of the temperature of the plating solution.

An air-bubble removal method has therefore been practiced which involves creating an upward flow of plating solution, flowing from a lower position in a plating cell toward the liquid surface, in the plating solution in the plating cell to raise the center of the liquid surface, thereby forcing air bubbles, which accumulate on the lower surface of a substrate upon its contact with the plating solution, out of the substrate. However, in the case where a resistor body is disposed between an anode and a substrate as described above, the upward flow of plating solution toward the liquid surface is blocked by the resistor body, whereby a raised portion cannot be formed in the liquid surface. Thus, in the case of a face-down type of plating apparatus which uses a resistor body, it has been difficult to remove air bubbles which accumulate on the lower surface of a substrate upon its contact with a plating solution. In order to enhance the in-plane uniformity of a thickness of a plated film by the use of a resistor body, it is necessary to shut off current pathways other than those current pathways which run through the resistor body and to dispose the resistor body at a small distance, such as not more than 5 mm, from a substrate. It has been difficult, however, to allow a plating solution, whose temperature is regulated in consideration of the heat produced by the resistor body, to flow smoothly in such a narrow space between the substrate and the resistor body without stagnation.

SUMMARY OF THE INVENTION

The present invention has been made in view of the above situation. It is therefore an object of the present invention to provide a plating method and a plating apparatus which, despite employing a face-down manner of plating and using a resistor body between a substrate and an anode, can securely bring the entire surface to be plated of the substrate into contact with a plating solution without permitting intrusion of air bubbles to the surface to be plated, thereby enabling uniform plating, and which can easily regulate the temperature of the plating solution.

In order to achieve the above object, the present invention provides a plating method for carrying out plating of a downwardly-facing surface to be plated of a substrate by applying a voltage between the surface to be plated and an anode disposed below the substrate in the presence of a plating solution between the surface to be plated and the anode. The method comprises disposing a resistor body above the anode and immersing the resistor body in the plating solution, allowing the plating solution to flow along an upper surface of the resistor body from the periphery toward the center of the resistor body, thereby creating a raised portion of the plating solution in the center of the upper surface of the resistor body, and then lowering the substrate with the surface to be plated facing downwardly so as to fill the space between the surface to be plated of the substrate and the upper surface of the resistor body with the plating solution. Thus, according to the present invention, a plating solution is allowed to flow, not upwardly from the bottom of a plating cell, but laterally along the upper surface of the resistor body toward the center of the resistor body so that inward flows of the plating solution collide with each other in the center of the resistor body, thereby creating a raised portion in the surface of the plating solution.

According to the present invention, a raised portion can be created in a surface of a plating solution under the center of a substrate when the substrate is lowered and brought into contact with the plating solution. Therefore, the center of the substrate can be first brought into contact with the plating solution, and then the contact area can be broadened to the periphery of the substrate. This makes it possible to bring the substrate into contact with the plating solution without permitting air bubbles to intrude between the substrate and the plating solution, thus enabling uniform plating despite the use of a resistor body in a face-down type of plating apparatus. Further, the use of the resistor body can enhance the in-plane uniformity of a thickness of a plated film.

Further, even when the space between the substrate and the resistor body is narrow (e.g., the distance is not more than 5 mm) and, due to the flow passage resistance, there are some places where the plating solution easily flows and some places where the plating solution hardly flows and thus the plating solution is likely to stagnate, it is possible to allow the plating solution to securely flow into the narrow space and flow over the entire surface of the substrate without stagnation by allowing the plating solution to flow from the periphery toward the center of the resistor body. By thus allowing the plating solution to flow without stagnation, regulation of the temperature of the plating solution becomes possible.

The present invention provides another plating method for carrying out plating of a downwardly-facing surface to be plated of a substrate by applying a voltage between the surface to be plated and an anode disposed below the substrate in the presence of a plating solution between the surface to be plated and the anode. The method comprises disposing a resistor body, having a flat or convex upper surface, above the anode and immersing the resistor body in the plating solution, raising the resistor body to make a surface of the plating solution convex, and lowering the substrate to bring the surface to be plated into contact with the convex surface of the plating solution so as to fill the space between the surface to be plated of the substrate and the upper surface of the resistor body with the plating solution.

A raised portion of the plating solution can be created also by thus raising the resistor body. It becomes possible also with this method to securely bring the substrate into contact with the plating solution without permitting air bubbles to intrude between the substrate and the plating solution despite the use of the resistor body in a face-down type of plating apparatus, thus enabling uniform plating. Further, the use of the resistor body can enhance the in-plane uniformity of a thickness of a plated film.

The present invention provides yet another plating method for carrying out plating of a downwardly-facing surface to be plated of a substrate by applying a voltage between the surface to be plated and an anode disposed below the substrate in the presence of a plating solution between the surface to be plated and the anode, the method comprising disposing a resistor body, having a flat or convex upper surface, above the anode and immersing a plating cell, housing the anode and the resistor body, in the plating solution, raising the plating cell to make a surface of the plating solution convex, and lowering the substrate to bring the surface to be plated into contact with the convex surface of the plating solution so as to fill the space between the surface to be plated of the substrate and the upper surface of the resistor body with the plating solution.

In the case where only a resistor body is moved vertically, a seal for prevention of current leakage, which is provided between the resistor body and a plating cell, can wear out. The wear of the seal can be prevented by vertically moving the resistor body and the plating cell as a unit.

The present invention also provides a plating apparatus comprising: a plating cell; an anode disposed in a plating cell; a resistor body disposed above the anode; a first plating solution supply section for supplying a plating solution between the anode and the resistor body, and a first plating solution discharge section for discharging the plating solution supplied between the anode and the resistor body; a second plating solution supply section for supplying a plating solution to an upper surface of the resistor body, and a second plating solution discharge section for discharging the plating solution supplied to the upper surface of the resistor body; a plating solution circulation mechanism for circulating the plating solution; a plating solution cooling mechanism for cooling the plating solution; a substrate holder for holding a substrate with its surface to be plated facing downwardly; and a seal for shutting off those electric pathways between the anode and the substrate which do not run through the resistor body. Plating of the surface to be plated of the substrate is carried out by bringing the surface to be plated of the substrate, held by the substrate holder, into contact with the plating solution.

The use of the resistor body in the face-down type of plating apparatus can enhance the in-plane uniformity of a thickness of a plated film. The temperature of a plating solution can be regulated with ease by circulating and cooling the plating solution by the plating solution supply sections, the plating solution discharge sections, the plating solution circulation mechanism and the plating solution cooling mechanism. The provision of the seal can prevent current leakage from between the seal and the plating cell. Further, with the resistor body as a boundary, the plating solution on the anode side can be separated from the plating solution on the substrate side. Accordingly, current pathways which do not run through the resistor body can be shut off.

Preferably, the second plating solution supply section allows the plating solution to flow along the upper surface of the resistor body from the periphery toward the center of the resistor body, thereby creating a raised portion of the plating solution in the center of the upper surface of the resistor body.

With this structure, when a substrate is lowered and brought into contact with a plating solution, the center of the substrate can be first brought into contact with the plating solution, and then the contact area can be broadened to the periphery of the substrate. This makes it possible to securely bring the substrate into contact with the plating solution without permitting air bubbles to intrude between the substrate and the plating solution, despite the use of the resistor body in the face-down type of plating apparatus, thus enabling uniform plating.

Further, when the space between the substrate and the resistor body is narrow (e.g., the distance is not more than 5 mm) and, due to the flow passage resistance, there are some places where the plating solution easily flows and some places where the plating solution hardly flows and thus the plating solution is likely to stagnate. It is still possible to allow the plating solution to securely flow into the narrow space and flow along the entire surface of the substrate without stagnation by allowing the plating solution to flow from the periphery toward the center of the resistor body.

In a preferred aspect, the resistor body has a flat or convex upper surface, and the plating apparatus further comprises a mechanism for vertically moving the resistor body.

A raised portion of the plating solution can be created also by thus raising the resistor body. It becomes possible also with this method to securely bring the substrate into contact with the plating solution without permitting air bubbles to intrude between the substrate and the plating solution, despite the use of the resistor body in the face-down type of plating apparatus, thus enabling uniform plating.

In a preferred aspect, the resistor body disposed in the plating cell has a flat or convex upper surface, the plating cell is disposed in a plating tank, and the plating apparatus further comprises a mechanism for vertically moving the plating cell.

In the case where only a resistor body is moved vertically, a seal for prevention of current leakage, which is provided between the resistor body and the plating cell, can wear out. The wear of the seal can be prevented by vertically moving the resistor body and the plating cell as a unit.

The plating apparatus may comprise a plurality of resistor bodies disposed above the anode.

Increasing the number of resistor bodies increases the resistance between the anode and a substrate. This can ensure the in-plane uniformity of a thickness of a plated film even for a substrate having a high sheet resistance. Further, the use of a plurality of divisional resistor bodies can increase the efficiency of cooling them.

DETAILED DESCRIPTION OF THE PREFERRED EMBODIMENTS

Preferred embodiments of the present invention will now be described in detail with reference to the drawings.

First Embodiment

Figure 1:
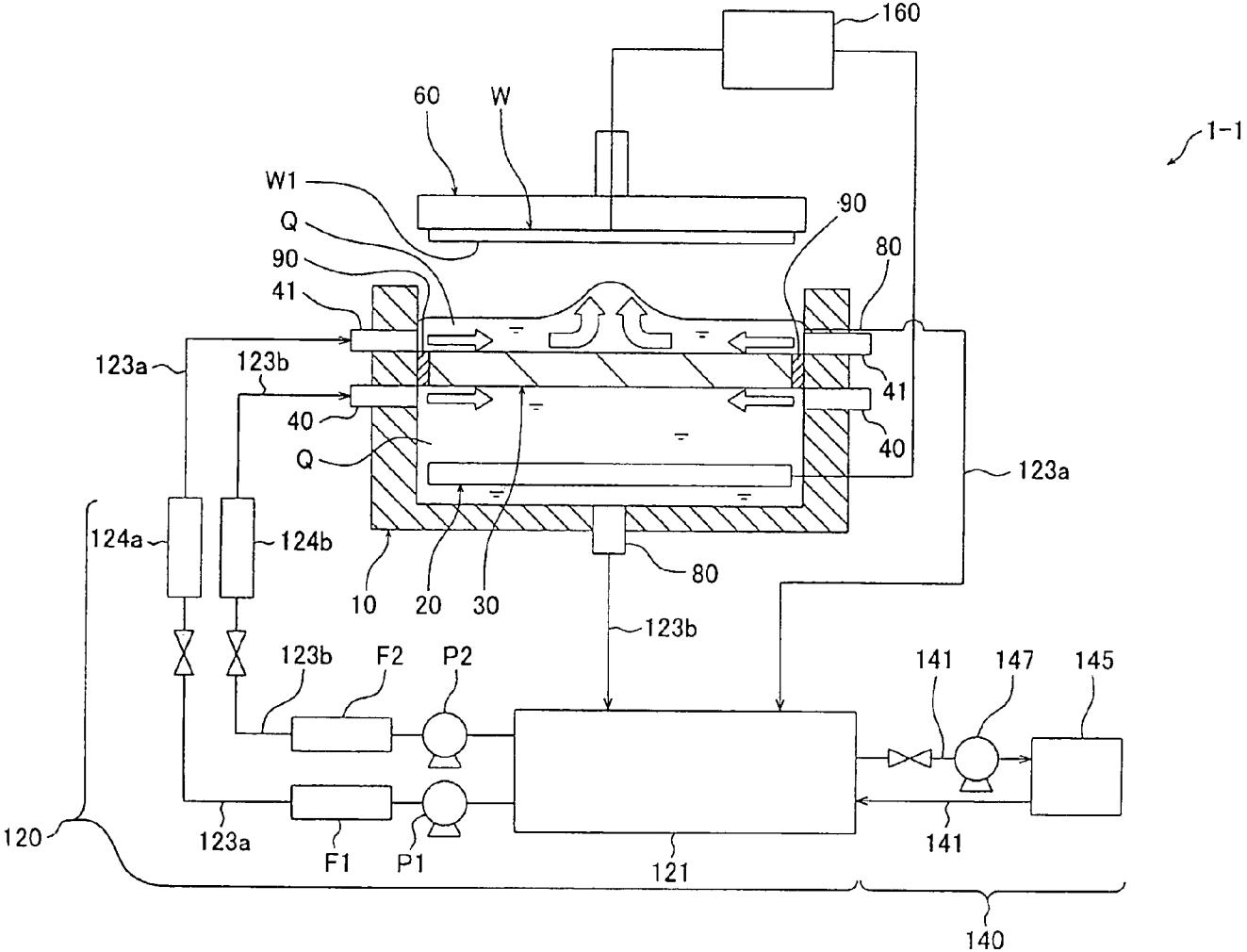
FIG. 1 is a schematic diagram showing the construction of a plating apparatus according to a first embodiment of the present invention.

FIG. 1 is a schematic diagram showing the construction of a plating apparatus 1-1 according to a first embodiment of the present invention. The plating apparatus 1-1 shown in FIG. 1 comprises a plating cell 10 for holding a plating solution Q, an anode 20 disposed in the plating cell 10, a resistor body 30 disposed above the anode 20, plating solution supply pipes (first plating solution supply section) 40 and plating solution jet supply mechanisms (second plating solution supply section) 41, for supplying the plating solution Q into the plating cell 10 until a surface of the plating solution Q reaches a level above the resistor body 30, plating solution discharge pipes (first plating solution discharge section and second plating solution discharge section) 80 for discharging the plating solution Q under the resistor body 30 and the plating solution Q over the resistor body 30, respectively, a plating solution circulation mechanism 120 for circulating the plating solution Q, a plating solution cooling mechanism 140 for cooling the plating solution, a substrate holder 60 for holding a substrate W with its surface W1 to be plated facing downwardly, and a seal 90 for shutting off those electric pathways between the anode 20 and the substrate W which do not run through the resistor body 30. The respective components will now be described.

The plating cell 10 is a boxy vessel which is designed to put and hold therein the plating solution Q. The anode 20, having a flat upper surface, is placed horizontally at a lower position in the plating cell 10. An insoluble anode is used as the anode 20 in this embodiment.

The resistor body 30 has a plate-like shape, with the circumference conforming to the inner contour of the plating cell 10. In this embodiment, the resistor body 30 is a plate-like ceramic porous body, in particular, a porous structure having a porosity of not more than 30%, e.g. composed of silicon carbide, silicon carbide which has undergone surface oxidation treatment, alumina or a plastic material, or a combination thereof. Though such a porous ceramic structure per se is an insulating material, it has an electric conductivity when it contacts a plating solution. In particular, the plating solution penetrates through the porous ceramic structure in the thickness direction through complicated, fairly long paths of the pores. This can provide the porous structure containing the plating solution with an electric conductivity which is lower than the electric conductivity of the plating solution.

To the circumference of the resistor body 30 is attached a ring-shaped seal 90 for shutting off those electric pathways between the anode 20 and the substrate W which do not run through the resistor body 30. The seal 90, which adheres to the resistor body 30, is disposed between the resistor body 30 and the plating cell 10. Though the seal 90 and the plating cell 10 can move relative to each other, there is no leakage of current from between the seal 90 and the plating cell 10. An example of the seal 90 is a resin coating on the circumference of the resistor body 30. With the resin intruding into pores in the surface of the porous resistor body 30, the resin seal 90 adheres firmly to the resistor body 30 and can prevent leakage of current from between the resistor body 30 and the plating cell 10.

A plurality of the plating solution supply pipes 40 are connected to the sidewall of the plating cell 10 at positions just below the resistor body 30, and supply the plating solution Q into the plating cell 10. A plurality (eight in this embodiment) of the plating solution jet supply mechanisms 41 are connected to the sidewall of the plating cell 10 at positions just above the resistor body 30, the mechanisms 41 being disposed at approximately equal intervals such that they surround the resistor body 30. Each mechanism 41 jets the plating solution Q so that it flows (almost horizontally) along the upper surface of the resistor body 30 from the periphery toward the center of the resistor body 30 (plating cell 10). The flow velocity of the plating solution Q jetted from the plating solution jet supply mechanisms 41 is made higher than the flow velocity of the plating solution Q ejected from the plating solution supply pipes 40. The plating solution discharge pipes 80 are connected to the bottom of the plating cell 10 and to the sidewall of the plating call 10 at a position above the resistor body 30, and discharge the plating solution Q under the resistor body 30 and the plating solution Q over the resistor body 30, respectively, from the plating cell 10.

The plating solution circulation mechanism 120 circulates the plating solution Q in the plating cell 10, and includes a plating solution tank 121 for holding the plating solution, and piping 123*a*, 123*b* connected so as to supply the plating solution in the plating solution tank 121 to above and below the resistor body 30 in the plating cell 10 in a circulatory manner. The piping 123*a* is provided with a pump P1, a filter F1 and a flow meter 124*a*, and the piping 123*b* is provided with a pump P2, a filter F2 and a flow meter 124*b*. The ends of the piping 123*a* are connected to the plating solution jet supply mechanisms 41 and to the plating solution discharge pipe 80 connected to the sidewall of the plating cell 10, and the ends of the piping 123*b* are connected to the plating solution supply pipes 40 and to the plating solution discharge pipe 80 connected to the bottom of the plating cell 10. In the plating solution tank 121, the plating solution to be supplied to above the resistor body 30 in the plating cell 10 is separated from the plating solution to be supplied to below the resistor body 30, so that the plating solution Q between the upper surface of the resistor body 30 and the substrate W and the plating solution Q between the lower surface of the resistor body 30 and the plating cell 10 circulate independently.

The plating solution cooling mechanism 140 cools the plating solution Q, and comprises a cooling apparatus 145, piping 141 which connects the cooling apparatus 145 to the plating solution tank 121 so that the plating solution circulates between them, and a pump 147 provided in the piping 141 to control the temperature of the plating solution in the plating solution tank 121 at a predetermined temperature. Though in this embodiment the plating solution Q supplied to above the resistor body 30 in the plating cell 10 and the plating solution Q supplied to below the resistor body 30 are cooled and controlled at an equal temperature, it is also possible, in some cases, to independently control the temperatures of the respective plating solutions at different temperatures. A plating power source 160 is connected between the substrate W and the anode 20.

Figure 2A:
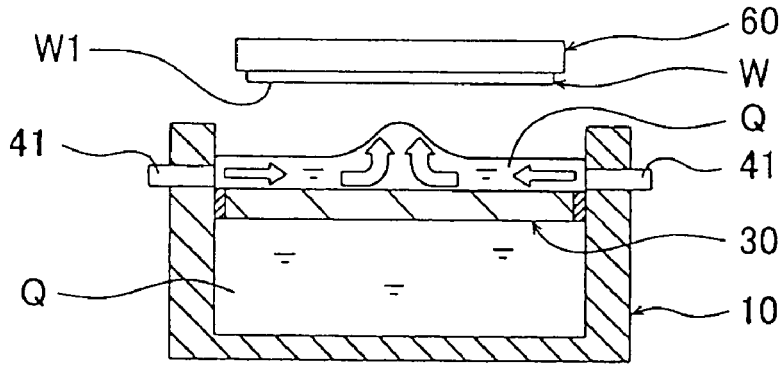
FIGS. 2A through 2C are diagrams illustrating the operation of the plating apparatus shown in FIG. 1.
Figure 2B:
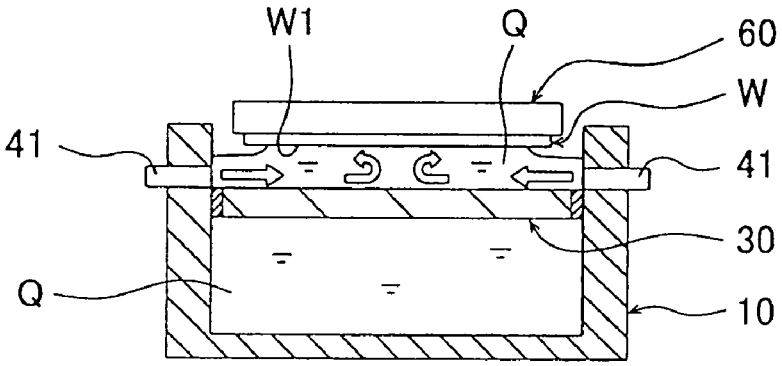
Figure 2C:
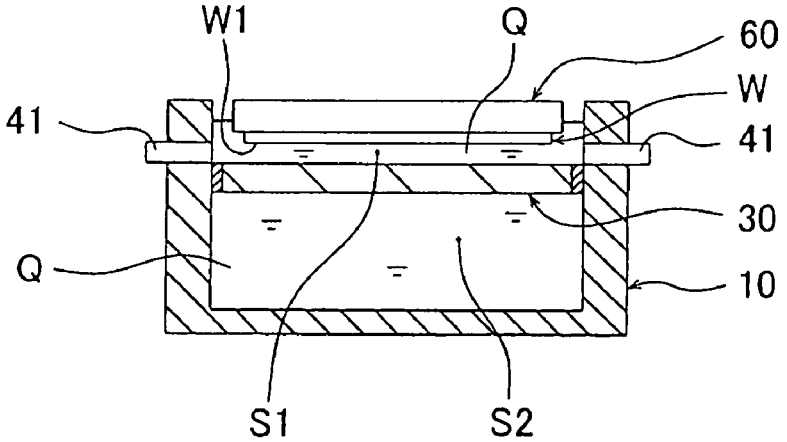

The operation of the plating apparatus 1-1 will now be described. FIGS. 2A through 2C are diagrams illustrating the operation of the plating apparatus 1-1 (only members necessary for illustration are shown in FIGS. 2A through 2C). Referring first to FIG. 1, the pumps P1, P2 of the plating solution circulation mechanism 120 are driven to supply the plating solution Q into the plating cell 10 from the plating solution supply pipes 40 and the plating solution jet supply mechanisms 41 (i.e., the first and second plating solution supply sections), and the plating solution Q is circulated. On the other hand, the plating solution cooling mechanism 140 is driven to control the temperature of the plating solution so that the temperature of the plating solution Q over the resistor body 30 falls within a predetermined control temperature range (control range). In this embodiment, the control range is, for example, 20 to 28° C.

When the plating solution Q is jetted from the plurality (eight) of plating solution jet supply mechanisms 41, provided around the resistor body 30, and the plating solution is allowed to flow along the upper surface of the resistor body 30 toward the center of the resistor body 30 (see FIG. 11), a raised portion of the plating solution Q is created in the center of the resistor body 30. When the substrate W, held with the surface W1 to be plated facing downwardly by the substrate holder 60, is then lowered as shown FIG. 2A, the center of the substrate W first comes into contact with the plating solution and, as the substrate W is further lowered, the contact area between the substrate W and the plating solution Q broadens to the periphery of the substrate W as shown in FIG. 2B. The lowering of the substrate W is continued until the space between the surface W1 to be plated of the substrate W and the upper surface of the resistor body 30 becomes filled with the plating solution as shown in FIG. 2C. The plating solution Q is thus supplied to the entire surface W1 to be plated. By thus creating a raised portion in the surface of the plating solution Q under the center of the substrate W when the substrate W is lowered and brought into contact with the plating solution Q, the center of the substrate W first comes into contact with the plating solution, and the contact area then broadens to the periphery of the substrate W. This makes it possible to securely bring the entire surface W1 to be plated of the substrate W into contact with the plating solution Q without permitting air bubbles to intrude into the interface between the surface W1 to be plated and the plating solution Q.

When the surface W1 to be plated of the substrate W has a large resistance (sheet resistance), due to the effect, a plated film tends to be thicker in the periphery of the substrate W than in the center. According to this embodiment in which the plating solution Q is first brought into contact with the center of the substrate W, it is possible to control the contact time and keep the raised portion of the plating solution Q in contact with only the central portion of the substrate W so as to carry out plating of the central portion of the substrate, thereby further enhancing the in-plane uniformity of a thickness of a plated film.

In this embodiment, by circulating the plating solution Q by the plating solution circulation mechanism 120, it becomes possible to regulate the temperature of the plating solution by the plating solution cooling mechanism 140. The temperature of the plating solution is regulated by the plating solution cooling mechanism 140 so that the temperature of the plating solution over the resistor body 30 falls within a predetermined control temperature range. This enables good plating. It is noted, in this regard, that as interconnects are becoming finer, the resistance of a substrate W (resistance of, e.g., a seed layer) will be increasingly higher from now on. Uniform plating may be carried out for a substrate W having a high-resistance seed layer by using a high-resistance resistor body 30. The use of a resistor body 30 having a higher resistance, however, involves a larger amount of heat generated by the resistor body 30 upon application of an electric current. Since the resistor body 30 is disposed in the vicinity of a substrate W, e.g., at a distance of not more than 5 mm from the substrate W, with the plating solution Q present between them, a rise in the liquid temperature due to the generation of heat by the resistor body 30 has a considerable influence on the quality of a plated film. In particular, a rise in the temperature of the plating solution Q can deactivate an additive contained in the plating solution, resulting in failure to obtain a plated film having good gloss and a uniform thickness. Good plating becomes possible by regulating the temperature of the plating solution Q to be supplied between a substrate W and the resistor body 30 and the temperature of the plaiting solution Q to be supplied between the lower surface of the resistor body 30 and the plating cell 10, so that the temperature of the plating solution Q supplied to the space S1 between the substrate W and the resistor body 30 falls within a control temperature range.

The space 51 between the substrate W in the lowered position shown in FIG. 2C and the resistor body 30 is made as narrow as a distance of not more than 5 mm. This is in view of uniformity of a thickness of a plated film. As will be described later with reference to FIG. 19, a variation (relative standard deviation) of not more than 2% is required for uniformity of a thickness of a plated film. As can be seen from FIG. 19, the distance between the resistor body 30 and the substrate W needs to be not more than 5 mm in order to make the variation within 2%. When the distance between the resistor body 30 and the substrate W is made not more than 5 mm, the plating solution Q is to flow in a narrow circular space S1, for example, having a diameter of 300 mm and a thickness of not more than 5 mm. In such a narrow space, due to the flow passage resistance, there will be some places where the plating solution Q easily flows and some places where the plating solution Q hardly flows, and thus it is difficult to allow the plating solution Q to flow over the entire surface of the substrate W without stagnation. According to this embodiment, by supplying the plating solution Q from the periphery toward the center of the substrate W, it becomes possible to allow the plating solution Q to securely flow into the narrow space S1 between the substrate W and the resistor body 30 and to flow over the entire surface W1 to be plated of the substrate W without stagnation.

When carrying out plating with the provision of the resistor body 30 between the anode 20 and a substrate W, it is necessary to shut off electric pathways other than the resistor body 30 in order to equalize the current density on the surface W1 to be plated of the substrate W for equalization of a thickness of a plated film. If the same plating solution Q is circulated to the space S1 formed between the upper surface of the resistor body 30 and the substrate W and to the space S2 (see FIG. 2C) formed by the lower surface of the resistor body 30 and the plating cell 10, electric current can flow from the anode 20 to the substrate W via the plating solution Q without passing through the resistor body 30. According to this embodiment, in addition to the provision of the seal 90, the plating solution Q is independently circulated to the space S1 and to the space S2 by the plating solution circulation mechanism 120, thereby separating the plating solution Q on the anode 20 side from the plating solution Q on the substrate W side with the resistor body 30 as the boundary and shutting off current pathways other than the resistor body 30.

Second Embodiment

Figure 3:
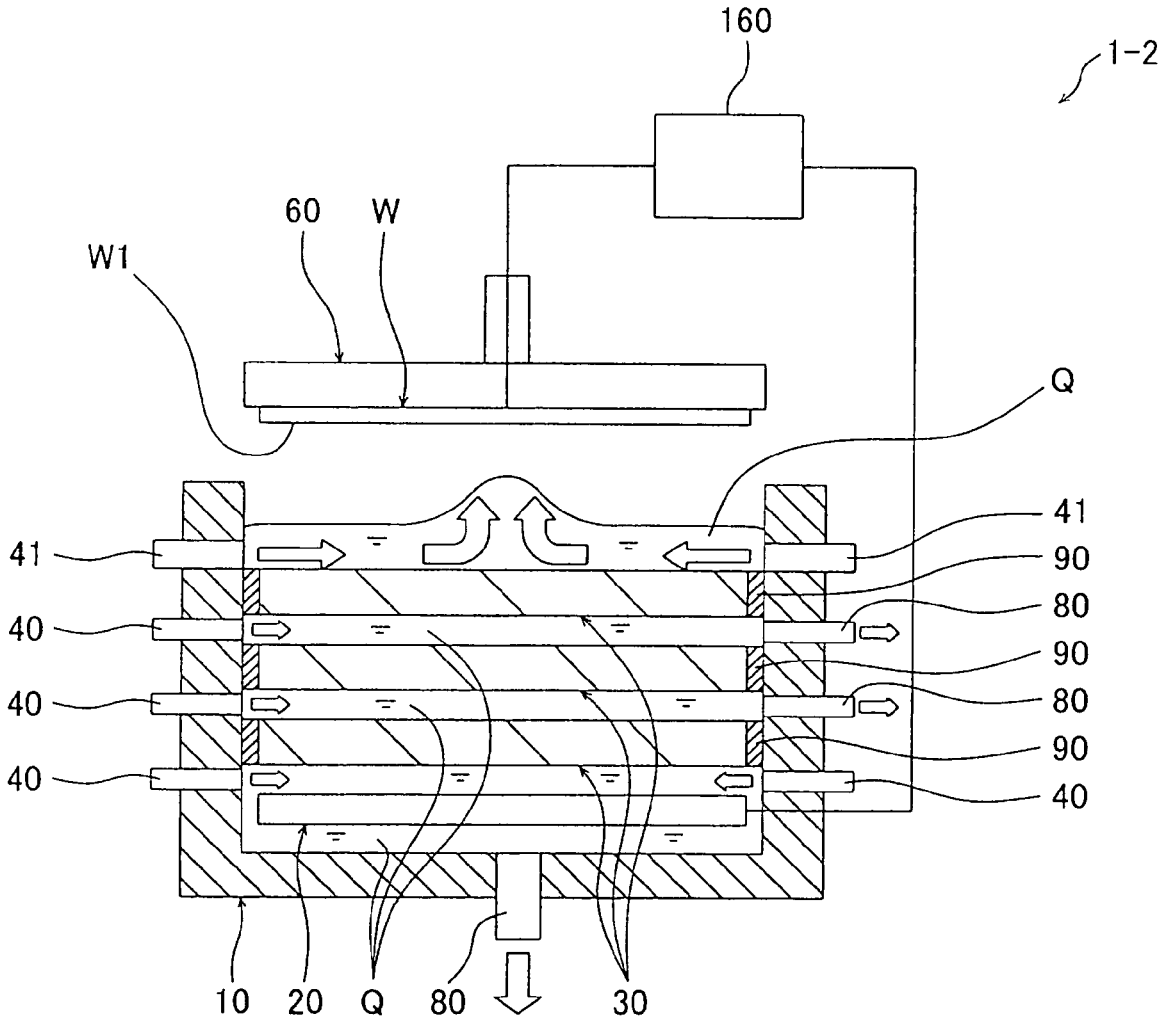
FIG. 3 is a schematic diagram showing the construction of a plating apparatus according to a second embodiment of the present invention.

FIG. 3 is a schematic diagram showing the construction of a plating apparatus 1-2 according to a second embodiment of the present invention. In the plating apparatus 1-2 shown in FIG. 3, the same or equivalent components as or to those of the plating apparatus 1-1 shown in FIG. 1 are given the same reference numerals. The construction of the plating apparatus 1-2 is the same as the plating apparatus 1-1 shown in FIG. 1 except for the respects described below. The plating apparatus 1-2 differs from the plating apparatus 1-1 in that a plurality of resistor bodies 30 are provided at predetermined intervals in the vertical direction, and that the plating solution supply pipe (plating solution supply section) 40 and the plating solution discharge pipe (plating solution discharge section) 80 are also provided for each of the spaces between the resistor bodies 30. Though not shown diagrammatically, the plating solution discharge pipe for discharging the plating solution Q over the upper surface of the uppermost resistor body 30 is provided as in the first embodiment. The seal 90 is attached to the circumference of each resistor body 30. In FIG. 3, a depiction of the plating solution circulation mechanism 120 and the plating solution cooling mechanism 140, both shown in FIG. 1, is omitted.

Increasing the number of resistor bodies 30 increases the resistance between the anode 20 and a substrate W. This can ensure the in-plane uniformity of a thickness of a plated film even for a substrate W having a high sheet resistance. Further, the use of a plurality of divisional resistor bodies 30 can increase the efficiency of cooling them. The operation of the plating apparatus 1-2 is the same as the above-described operation of the plating apparatus 1-1.

Third Embodiment

Figure 4:
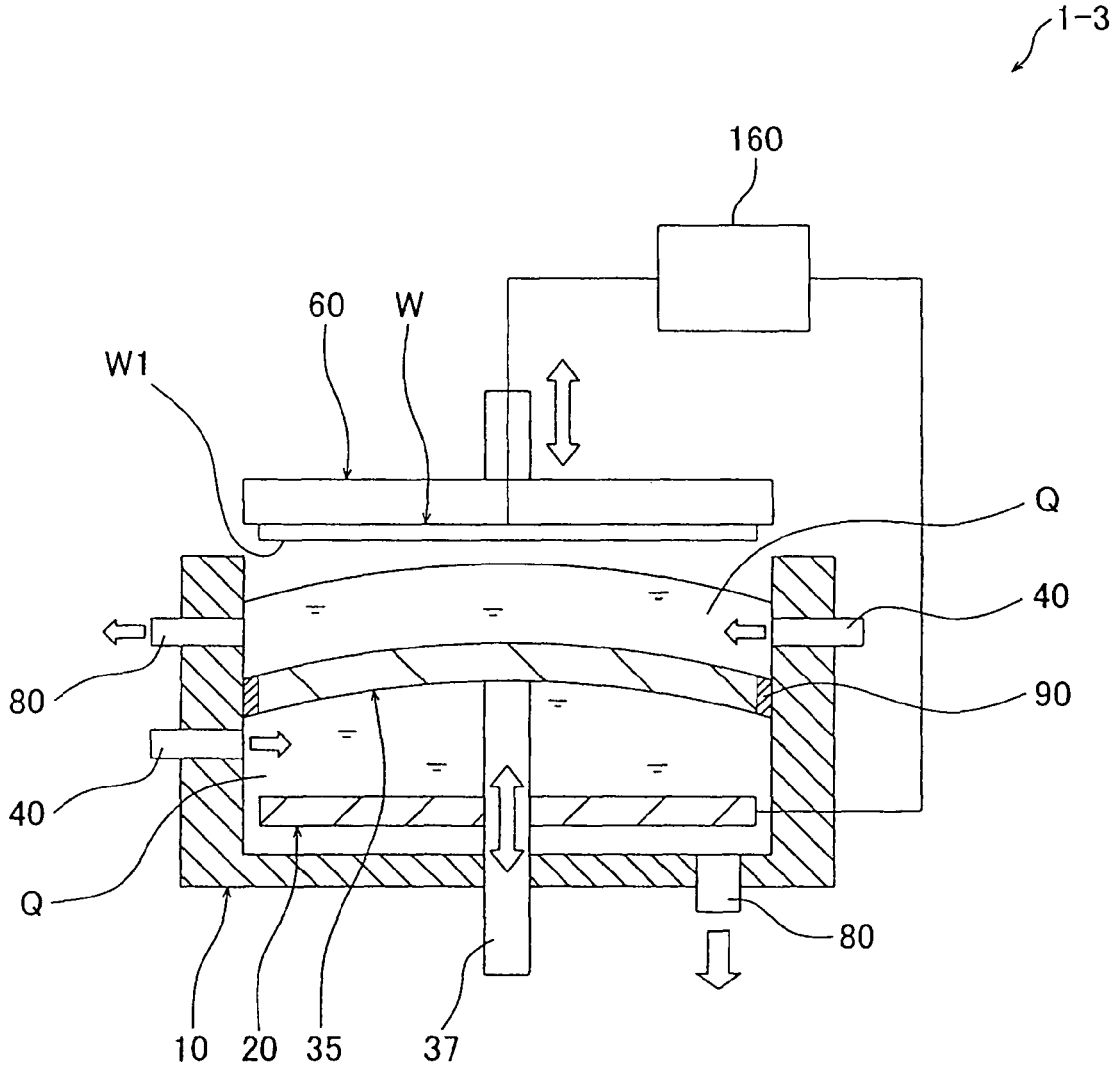
FIG. 4 is a schematic diagram showing the construction of a plating apparatus according to a third embodiment of the present invention.

FIG. 4 is a schematic diagram showing the construction of a plating apparatus 1-3 according to a third embodiment of the present invention. In the plating apparatus 1-3 shown in FIG. 4, the same or equivalent components as or to those of the plating apparatus 1-1 shown in FIG. 1 are given the same reference numerals. The construction of the plating apparatus 1-3 is the same as the plating apparatus 1-1 shown in FIG. 1 except for the respects described below. The plating apparatus 1-3 differs from the plating apparatus 1-1 in that a resistor body (convex resistor body) 35 having a convex (generally spherical) upper surface is provided above the anode 20, and the resistor body 35 is made vertically movable. In order for the resistor body 35 to be vertically movable, it is provided at the center of the lower surface with a rod 37 which penetrates through the anode 20 and the bottom of the plating cell 10 and is connected to a not-shown external lifting drive mechanism. Instead of the plating solution jet supply mechanism 41, a plating solution supply pipe 40, having the same construction as the plating solution supply pipe 40 for supplying the plating solution to below the resistor body 35, is provided. FIG. 4 shows the plating solution discharge pipe 80 for discharging the plating solution Q over the resistor body 35. The resistor body 35 of this embodiment has a concave lower surface. The vertical movement of the resistor body 35 and the vertical movement of a substrate W are controlled independently of each other.

Figure 5A:
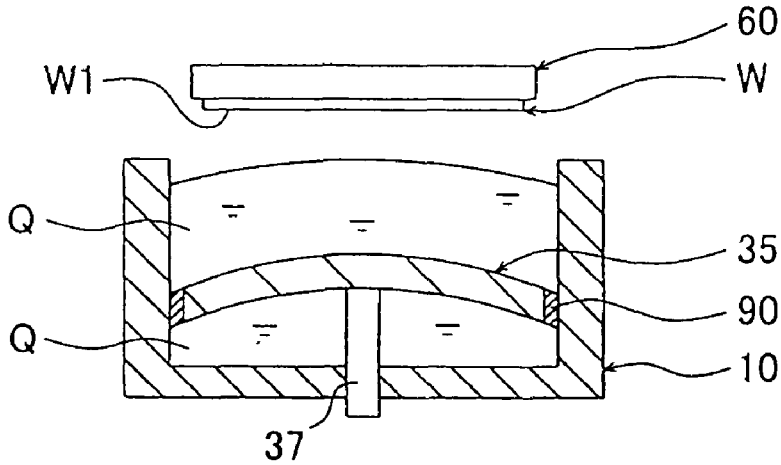
FIGS. 5A through 5C are diagrams illustrating the operation of the plating apparatus shown in FIG. 4.
Figure 5B:
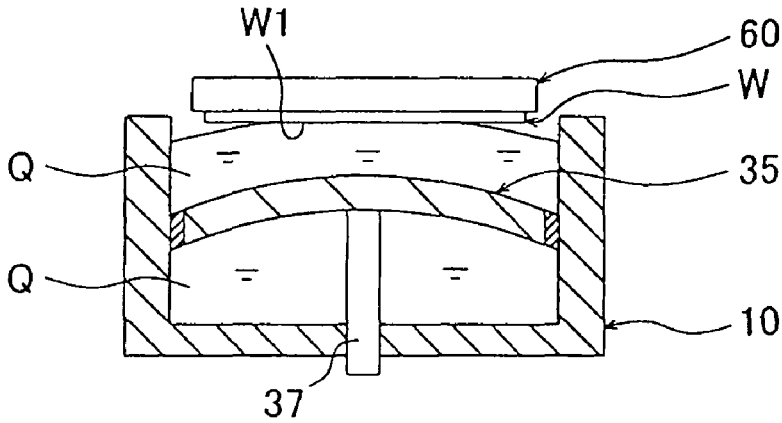
Figure 5C:
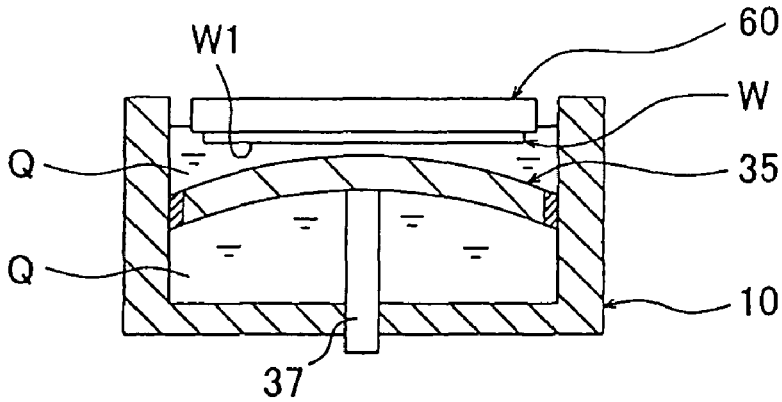

The operation of the plating apparatus 1-3 will now be described. FIGS. 5A through 5C are diagrams illustrating the operation of the plating apparatus 1-3. Referring first to FIG. 4, the plating solutions Q are supplied from the plating solution supply pipes 40 to above and below the resistor body 35 in the plating cell 10, the temperatures of the respective plating solutions being controlled at predetermined temperatures, thereby immersing the resistor body 35 in the plating solutions Q, and the plating solutions are circulated independently of each other.

As shown in FIGS. 4 and 5A, the surface of the plating solution becomes convex when the resistor body 35 is raised. The resistor body 35 is raised while keeping the convex liquid surface, while the substrate W held by the substrate holder 60 is lowered, thereby first bringing the plating solution Q into contact with the center of the surface W1 to be plated, as shown in FIG. 5B. By independently controlling the rise of the resistor body 35 and the lowering of the substrate W, the contact area between the plating solution Q and the surface W1 to be plated is broadened to the periphery of the surface W1 to be plated until the space between the entire surface W1 to be plated and the upper surface of the resistor body 35 becomes filled with the plating solution Q, as shown in FIG. 5C. The plating solution Q is supplied to the surface W1 to be plated in this manner. As with the above-described first embodiment, it becomes possible also in this embodiment to securely bring the plating solution Q into contact with the entire surface W1 to be plated of the substrate W without permitting air bubbles to intrude into the interface between the surface W1 to be plated and the plating solution Q. Especially by independently controlling the rise of the resistor body 35 and the lowering of the substrate W, as in this embodiment, timing of contact of the surface W1 to be plated of the substrate W with the plating solution Q and the state of the contact can be adjusted, enabling more secure removal of air bubbles upon the contact. Further, as with the first embodiment, it is possible to control the contact time and keep the raised portion of the plating solution in contact with only the central portion of the substrate W so as to carry out plating of the central portion of the substrate. This can further enhance the in-plane uniformity of a thickness of a plated film even when the surface W1 to be plated of the substrate W has a high resistance (sheet resistance). As with the first embodiment, regulation of the temperature of the plating solution Q by the plating solution cooling mechanism 140 (see FIG. 1) can be facilitated by circulating the plating solution, enabling good plating.

Though the resistor body 35 used in this embodiment has a convex upper surface and a concave lower surface, it is also possible to use a resistor body 35 having a flat upper surface or a flat lower surface.

Fourth Embodiment

Figure 6:
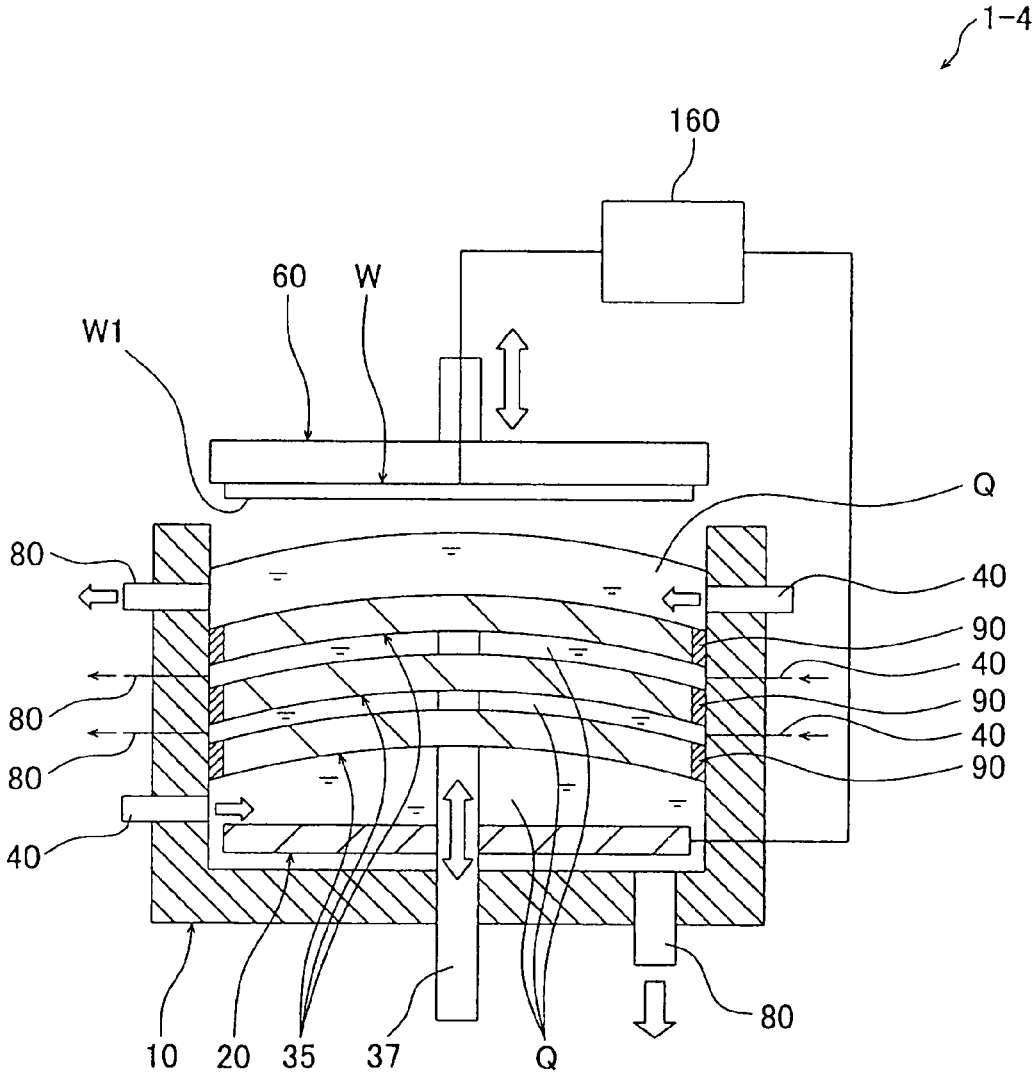
FIG. 6 is a schematic diagram showing the construction of a plating apparatus according to a fourth embodiment of the present invention.

FIG. 6 is a schematic diagram showing the construction of a plating apparatus 1-4 according to a fourth embodiment of the present invention. In the plating apparatus 1-4 shown in FIG. 6, the same or equivalent components as or to those of the plating apparatus 1-3 shown in FIG. 4 are given the same reference numerals. The construction of the plating apparatus 1-4 is the same as the plating apparatus 1-3 shown in FIG. 4 except for the respects described below. The plating apparatus 1-4 differs from the plating apparatus 1-3 in that a plurality of resistor bodies 35 having a convex (generally spherical) upper surface are provided at predetermined intervals in the vertical direction, and that the plating solution supply pipe (plating solution supply section) 40 for supplying the plating solution Q and the plating solution discharge pipe (plating solution discharge section) 80 for discharging the plating solution Q are provided also for each of the spaces between the resistor bodies 35. The seal 90 is attached to the circumference of each resistor body 35. In FIG. 6, a depiction of the plating solution circulation mechanism 120 and the plating solution cooling mechanism 140, both shown in FIG. 1, is omitted.

Increasing the number of resistor bodies 35 increases the resistance between the anode 20 and a substrate W. This can ensure the in-plane uniformity of a thickness of a plated film even for a substrate W having a high sheet resistance. Further, the use of a plurality of divisional resistor bodies 35 can increase the efficiency of cooling them. The operation of the plating apparatus 1-4 is the same as the above-described operation of the plating apparatus 1-3 of the third embodiment.

Fifth Embodiment

Figure 7:
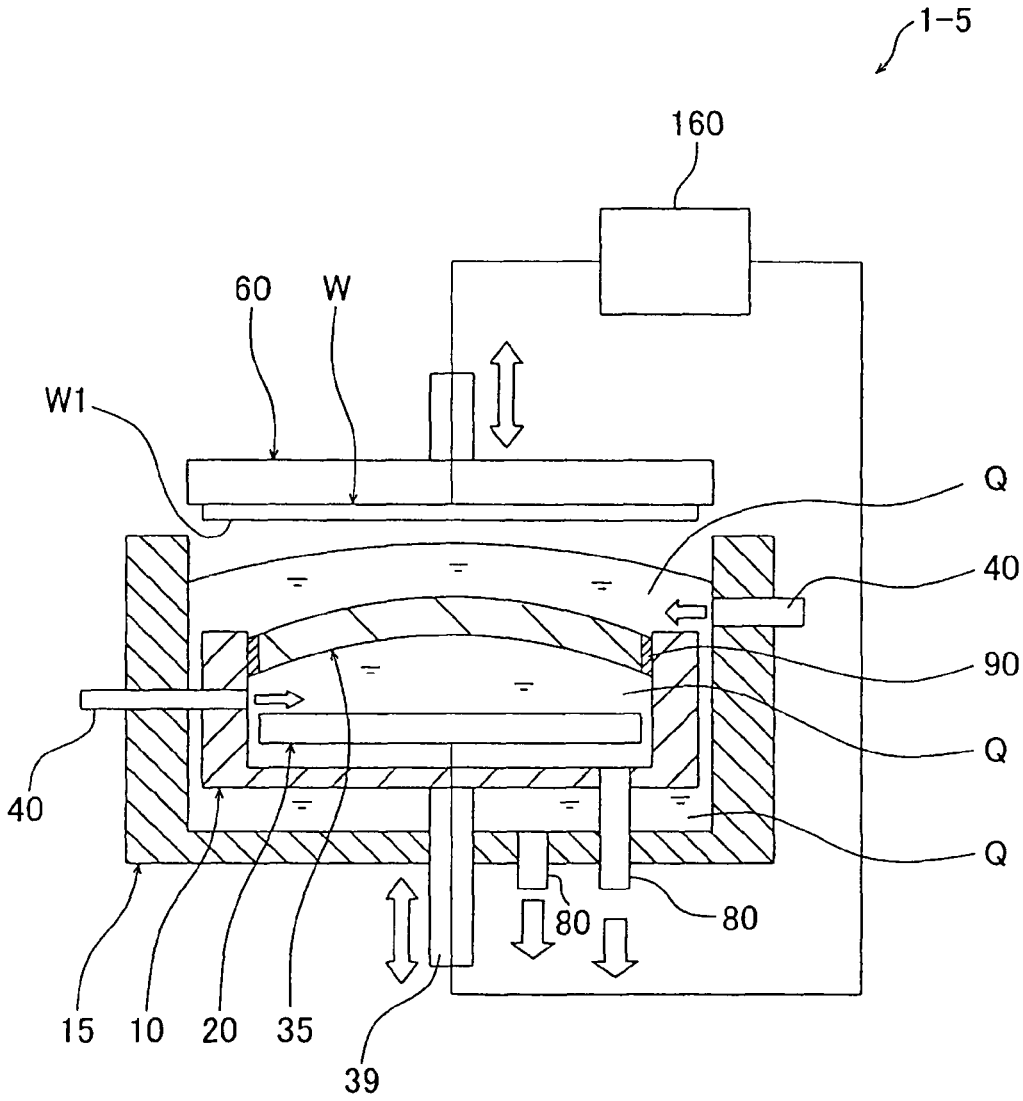
FIG. 7 is a schematic diagram showing the construction of a plating apparatus according to a fifth embodiment of the present invention.

FIG. 7 is a schematic diagram showing the construction of a plating apparatus 1-5 according to a fifth embodiment of the present invention. In the plating apparatus 1-5 shown in FIG. 7, the same or equivalent components as or to those of the plating apparatus 1-3 shown in FIG. 4 are given the same reference numerals. The construction of the plating apparatus 1-5 is the same as the plating apparatus 1-3 shown in FIG. 4 except for the respects described below. The plating apparatus 1-5 differs from the above-described plating apparatus 1-3 in that the plating cell 10, in which the resistor body 35 having a convex (generally spherical) upper surface is provided above the anode 20, is provided in a plating tank 15, and the plating cell 10 is made vertically movable, that in order for the plating cell 10 to be vertically movable, it is provided at the center of the lower surface with a rod 39 which penetrates through the bottom of the plating tank 15 and is connected to a not-shown external lifting drive mechanism, and that the plating solution supply pipe 40 for supplying the plating solution Q and the plating solution discharge pipe 80 for discharging the plating solution Q are provided in both of the plating cell 10 and the plating tank 15, respectively.

Figure 8A:
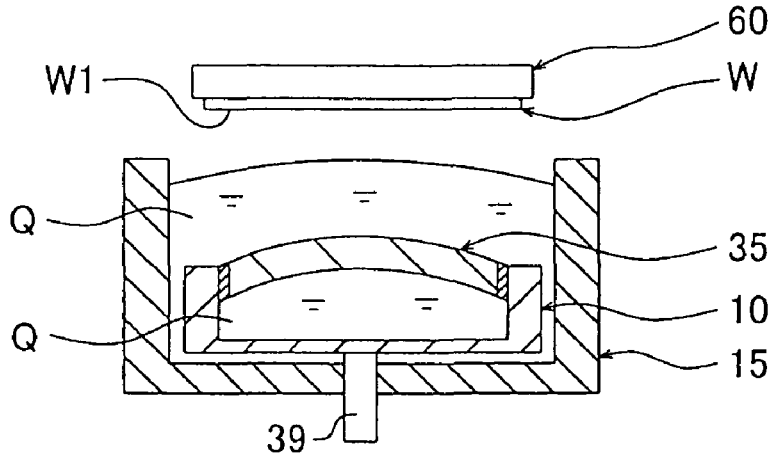
FIGS. 8A through 8C are diagrams illustrating the operation of the plating apparatus shown in FIG. 7.
Figure 8B:
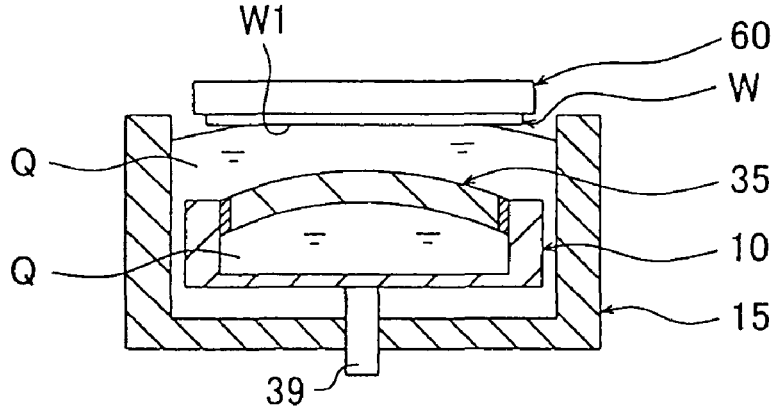
Figure 8C:
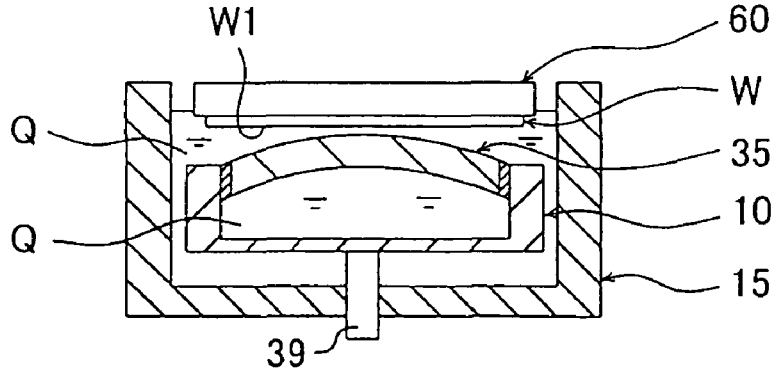

The operation of the plating apparatus 1-5 will now be described. FIGS. 8A through 8C are diagrams illustrating the operation of the plating apparatus 1-5. Referring to FIG. 7, the plating solutions Q are supplied from the plating solution supply pipes 40 into the plating cell 10 and the plating tank 15, the temperatures of the respective plating solutions being controlled at predetermined temperatures, thereby immersing the plating cell 10 in the plating solutions Q, and the plating solutions are circulated independently of each other.

As shown in FIGS. 7 and 8A, the surface of the plating solution becomes convex when the plating cell 10, which is integrated with the resistor body 35, is raised. The plating cell 10 and the resistor body 35 are raised while keeping the convex liquid surface, while the substrate W held by the substrate holder 60 is lowered, thereby first bringing the plating solution Q into contact with the center of the surface W1 to be plated, as shown in FIG. 8B. By independently controlling the rise of the plating cell 10 and the resistor body 35 and the lowering of the substrate W, the contact area between the plating solution Q and the surface W1 to be plated is broadened to the periphery of the surface W1 to be plated until the space between the entire surface W1 to be plated and the upper surface of the resistor body 35 becomes filled with the plating solution Q, as shown in FIG. 8C. The plating solution Q is supplied to the surface W1 to be plated in this manner. As with the above-described third embodiment, it becomes possible also in this embodiment to securely bring the plating solution Q into contact with the entire surface W1 to be plated of the substrate W without permitting air bubbles to intrude into the interface between the surface W1 to be plated and the plating solution Q. Especially by independently controlling the rise of the plating cell 10 and the lowering of the substrate W as in this embodiment, timing of contact of the surface W1 to be plated of the substrate W with the plating solution Q and the state of the contact can be adjusted, enabling more secure removal of air bubbles upon the contact. Further, as with the third embodiment, it is possible to control the contact time and keep the raised portion of the plating solution in contact with only the central portion of the substrate W so as to carry out plating of the central portion of the substrate. This can further enhance the in-plane uniformity of a thickness of a plated film even when the surface W1 to be plated of the substrate W has a high resistance (sheet resistance). As with the third embodiment, regulation of the temperature of the plating solution Q by the plating solution cooling mechanism 140 (see FIG. 1) can be facilitated by circulating the plating solution, enabling good plating.

In the case where only the resistor body 35 is moved vertically as in the above-described third embodiment, the seal 90 for prevention of current leakage, which is provided between the resistor body 35 and the plating cell 10, can wear out. According to this embodiment, the wear of the seal 90 can be prevented by vertically moving the resistor body 35 and the plating cell 10 as a unit.

Sixth Embodiment

Figure 9:
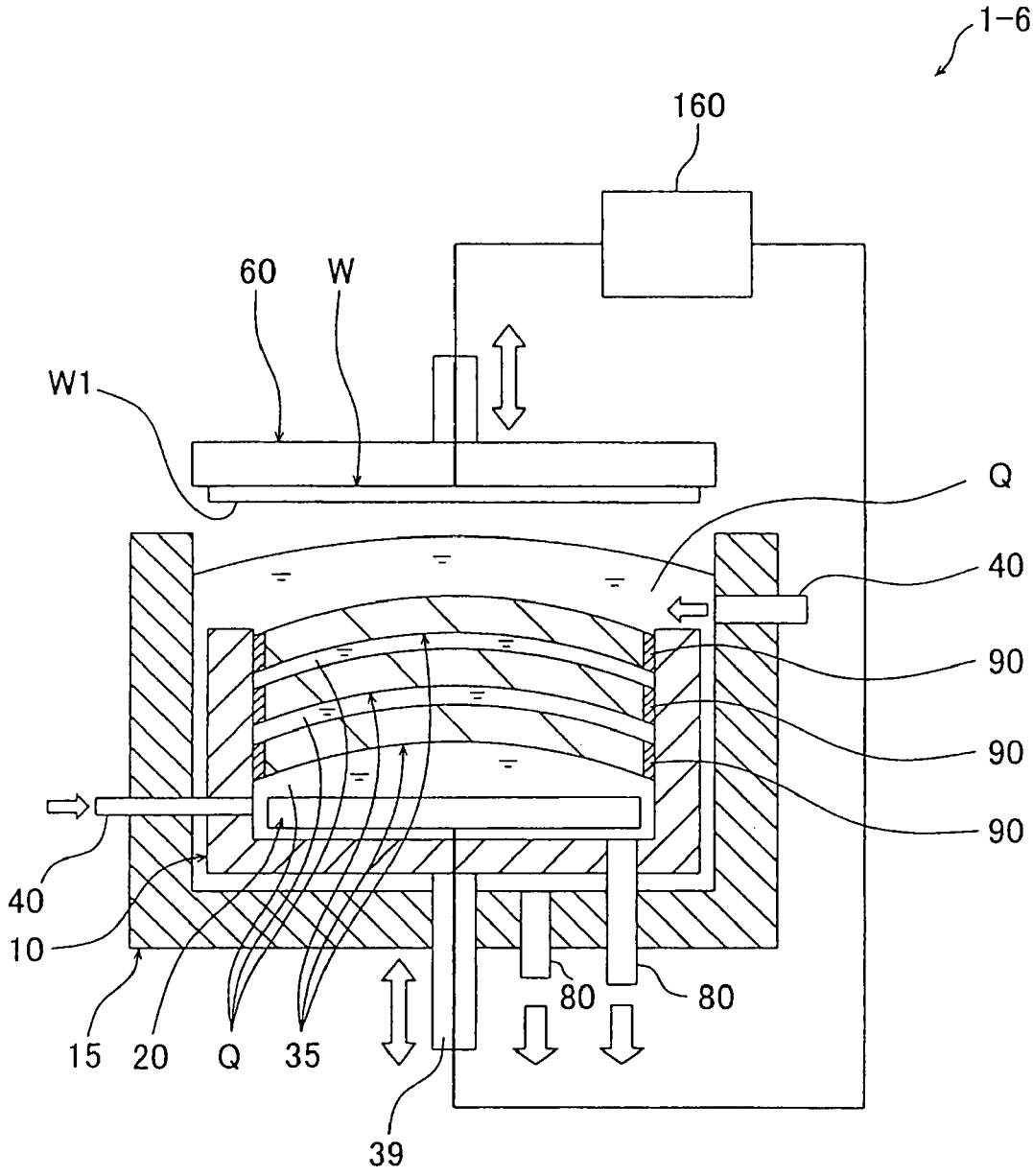
FIG. 9 is a schematic diagram showing the construction of a plating apparatus according to a sixth embodiment of the present invention.

FIG. 9 is a schematic diagram showing the construction of a plating apparatus 1-6 according to a sixth embodiment of the present invention. In the plating apparatus 1-6 shown in FIG. 9, the same or equivalent components as or to those of the plating apparatus 1-5 shown in FIG. 7 are given the same reference numerals. The construction of the plating apparatus 1-6 is the same as the plating apparatus 1-5 shown in FIG. 7 except for the respects described below. The plating apparatus 1-6 differs from the above-described plating apparatus 1-5 in that a plurality of resistor bodies 35 having a convex (generally spherical) upper surface are provided in the plating cell 10 at predetermined intervals in the vertical direction, and that a not-shown plating solution supply pipe (plating solution supply section) for supplying the plating solution Q and a not-shown plating solution discharge pipe (plating solution discharge section) for discharging the plating solution Q are provided also for each of the spaces between the resistor bodies 35. The seal 90 is attached between the outer circumference of each resistor body 35 and the inner circumferential surface of the plating cell 10. In FIG. 9, a depiction of the plating solution circulation mechanism 120 and the plating solution cooling mechanism 140, both shown in FIG. 1, is omitted.

Increasing the number of resistor bodies 35 increases the resistance between the anode 20 and a substrate W. This can ensure the in-plane uniformity of a thickness of a plated film even for a substrate W having a high sheet resistance. Further, the use of a plurality of divisional resistor bodies 35 can increase the efficiency of cooling them. The operation of the plating apparatus 1-6 is the same as the above-described operation of the plating apparatus 1-5 of the fifth embodiment.

Seventh Embodiment

Figure 10:
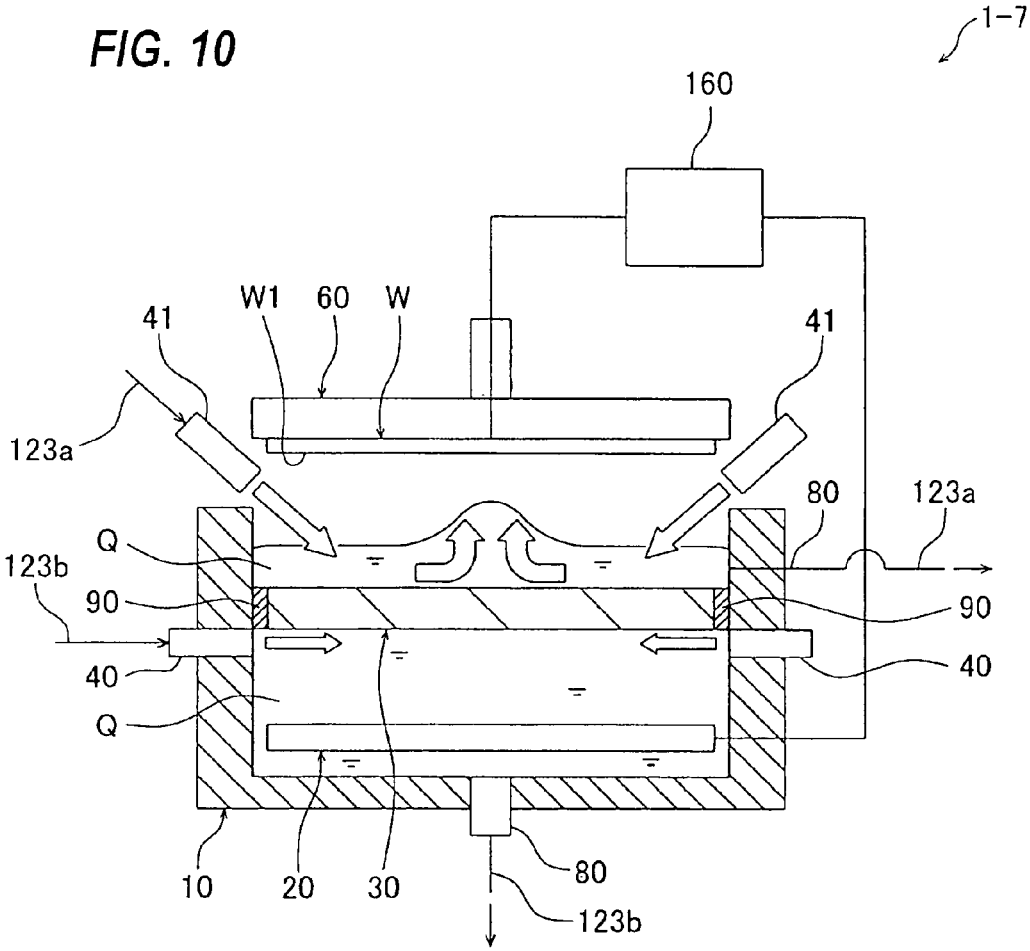
FIG. 10 is a schematic diagram showing the construction of a plating apparatus according to a seventh embodiment of the present invention.
Figure 11:
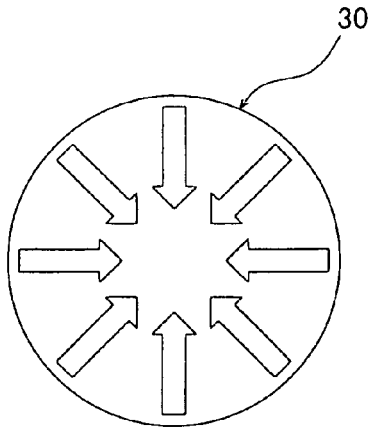
FIG. 11 is a diagram illustrating the directions of flows of a plating solution in the plating apparatus of FIG. 1 or the plating apparatus of FIG. 10.

FIG. 10 is a schematic diagram showing the construction of a plating apparatus 1-7 according to a seventh embodiment of the present invention. In the plating apparatus 1-7 shown in FIG. 10, the same or equivalent components as or to those of the plating apparatus 1-1 shown in FIG. 1 are given the same reference numerals. The construction of the plating apparatus 1-7 is the same as the plating apparatus 1-1 shown in FIG. 1 except for the respects described below. The plating apparatus 1-7 differs from the above-described plating apparatus 1-1 in that instead of providing the plating solution jet supply mechanisms 41 in the sidewall of the plating cell 10 as in the plating apparatus 1-1, a plurality (eight in this embodiment) of the plating solution jet supply mechanisms 41 are provided above the sidewall of the plating cell 10 (above the resistor body 30). The mechanisms 41 are disposed at approximately equal intervals such that they surround the resistor body 30, and each mechanism 41 jets the plating solution Q so that it flows along the upper surface of the resistor body 30 from the periphery toward the center of the resistor body 30 (plating cell 10), as shown in FIG. 11. In FIG. 10, a depiction of the plating solution circulation mechanism 120 and the plating solution cooling mechanism 140, both shown in FIG. 1, is omitted. The operation of the plating apparatus 1-7 is the same as the above-described operation of the plating apparatus 1-1 of the first embodiment.

Example 1

Figure 12:
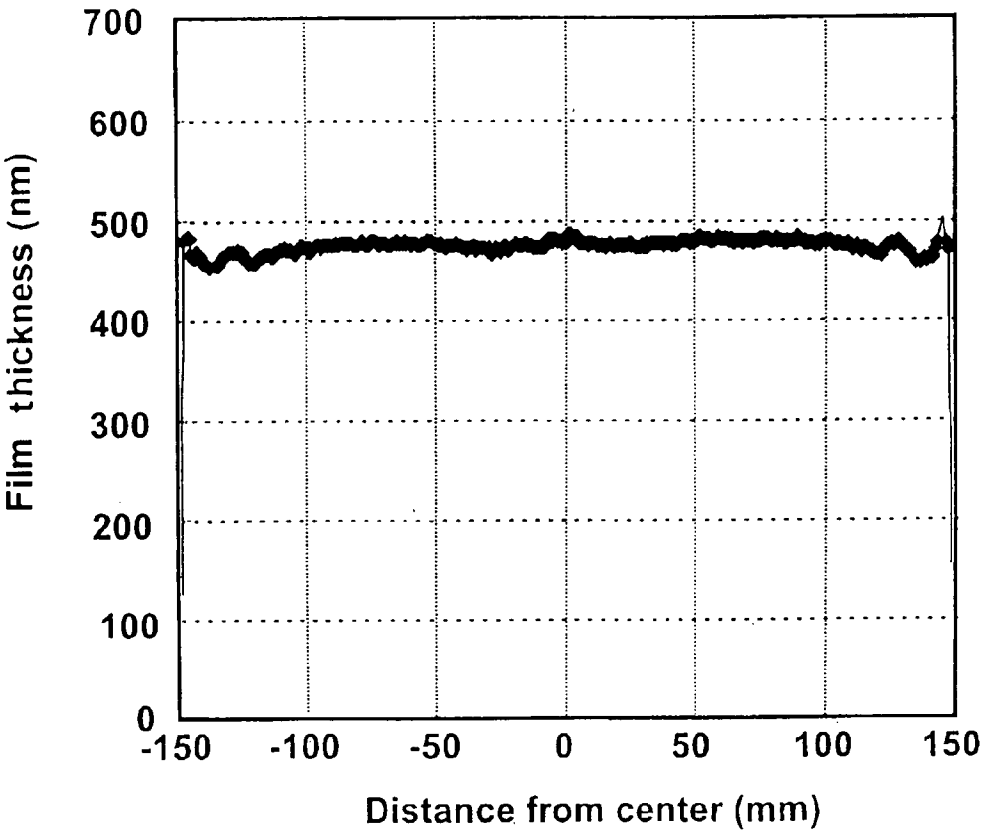
FIG. 12 is a diagram showing a thickness of a plated film obtained in Example 1.

The plating apparatus 1-1 shown in FIG. 1, the above-described porous body as the resistor body 30 and an insoluble anode as the anode 20 were used. The plating solution Q was prepared using copper sulfate, sulfuric acid, chlorine and an additive. A 300 mm-diameter silicon wafer having a 50 nm-thick copper seed layer was used as a substrate W. The substrate W was attached, with the surface W1 to be plated facing downwardly to the substrate holder 60, as shown in FIG. 1. At this moment, the substrate W was outside the plating solution Q. The plating solution Q was jetted and allowed to flow along the upper surface of the resistor body 30 in eight directions from the periphery toward the center of the resistor body 30, as shown in FIG. 11. Then the surface of the plating solution Q was raised like a spring in the center of the resistor body 30. Next, the substrate W held by the substrate holder 60 was lowered toward the plating solution Q and dipped into the plating solution Q (see FIGS. 2A through 2C). Plating was then carried out by supplying a plating current from the plating power source 160 so that a plated film having a thickness of 500 nm would be produced. As a result, a plated film having a uniform thickness, as shown in FIG. 12, was obtained.

Figure 19:
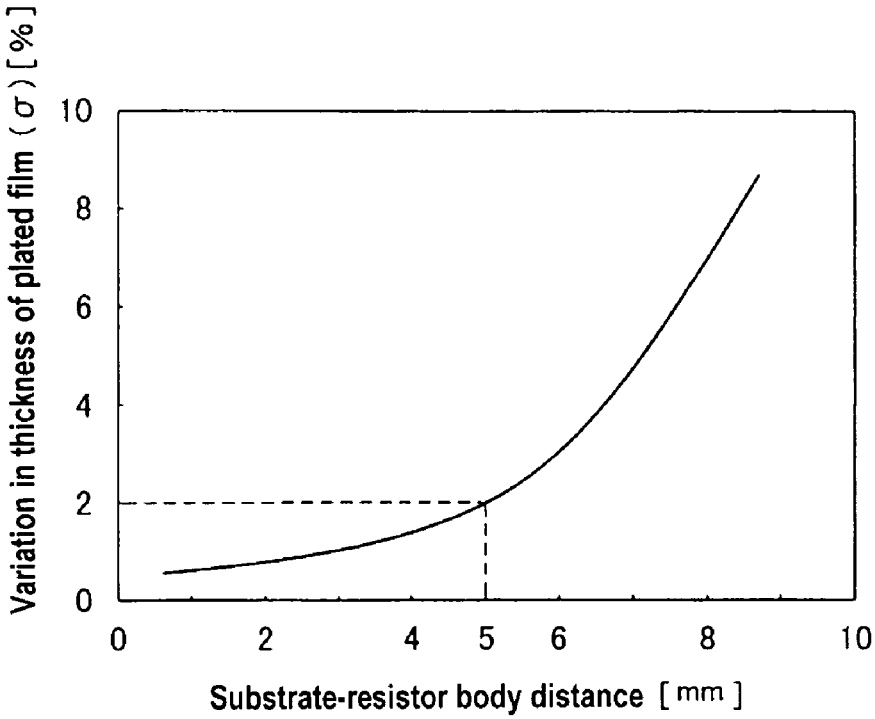
FIG. 19 is a diagram showing the relationship between substrate-resistor body distance and variation in a thickness of a plated film.

The present inventors also conducted an experiment in which plating of the substrate W was carried out in the manner described above with varying distances between the substrate W and the resistor body 30, ranging from about 1 mm to about 9 mm, in the apparatus 1-1, and variation (relative standard deviation) in a thickness of a plated film was measured. The results are shown in FIG. 19. A variation (relative standard deviation) of not more than 2% is required for uniformity of a thickness of a plated film. As can be seen from FIG. 19, the distance between the resistor body 30 and the substrate W needs to be not more than 5 mm in order to make the variation within 2%.

Example 2

Figure 13:
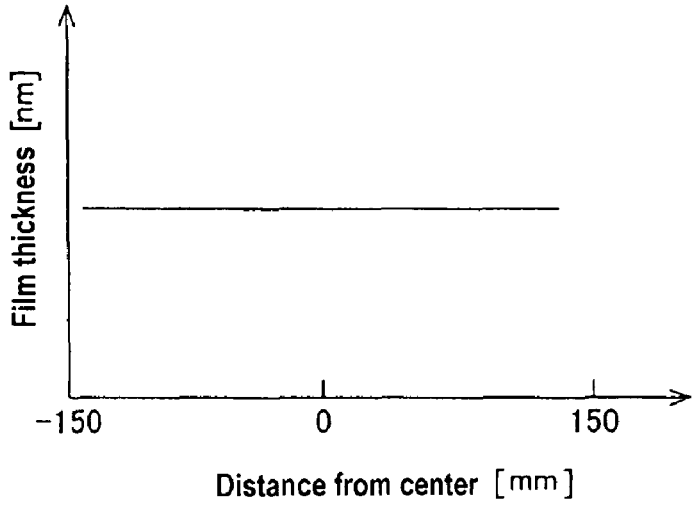
FIG. 13 is a diagram showing a thickness of a plated film obtained in Example 2.

The plating apparatus 1-7 shown in FIG. 10, the above-described porous body as the resistor body 30 and an insoluble anode as the anode 20 were used. The plating solution Q was prepared using copper sulfate, sulfuric acid, chlorine and an additive. A 300 mm-diameter silicon wafer having a 50 nm-thick copper seed layer was used as a substrate W. The substrate W was attached, with the surface W1 to be plated facing downwardly, to the substrate holder 60, as shown in FIG. 10. At that moment, the substrate W was outside the plating solution Q. The plating solution Q was jetted from above the sidewall of the plating cell 10 and allowed to flow along the upper surface of the resistor body 30 in eight directions from the periphery toward the center of the resistor body 30, as shown in FIG. 11. Then the surface of the plating solution Q was raised like a spring in the center of the resistor body 30. Next, the substrate W held by the substrate holder 60 was lowered toward the plating solution Q and dipped into the plating solution Q as in Example 1. Plating was then carried out by supplying a plating current from the plating power source 160 so that a plated film having a thickness of 500 nm would be produced. As a result, a plated film having a uniform thickness, as shown in FIG. 13, was obtained.

Comparative Example 1

Figure 14:
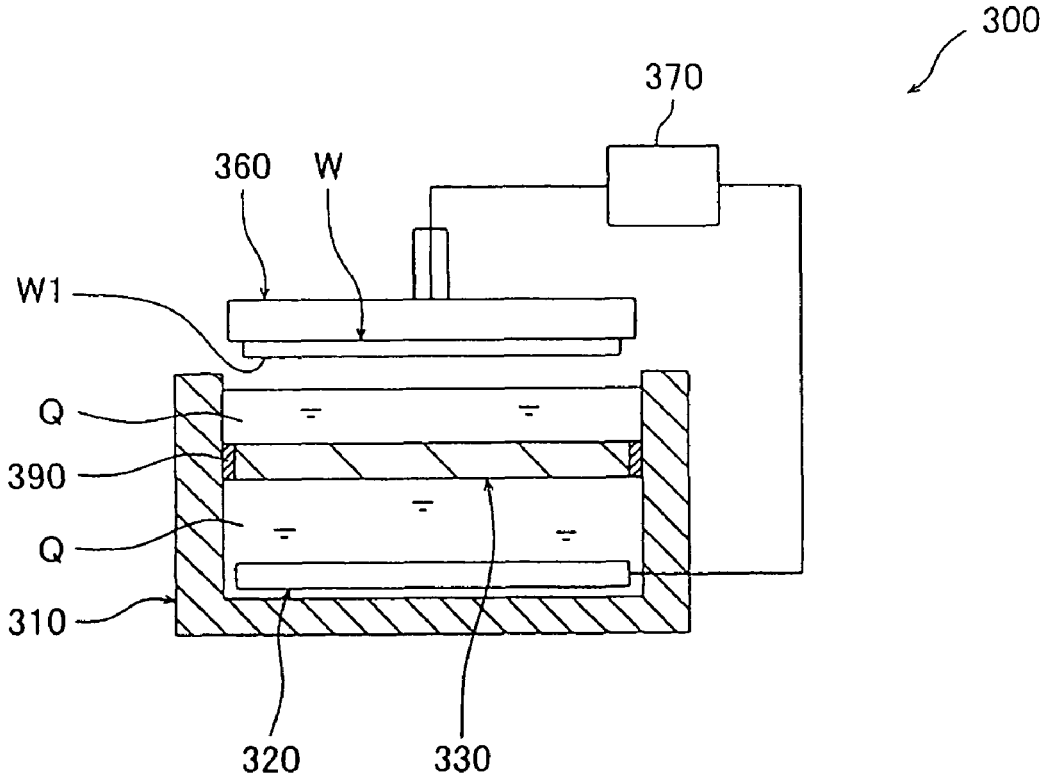
FIG. 14 is a schematic diagram showing the construction of a plating apparatus used in Comp. Example 1.
Figure 15:
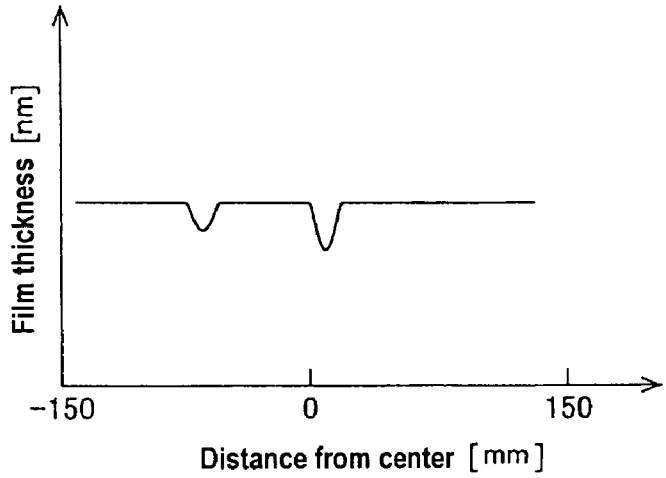
FIG. 15 is a diagram showing a thickness of a plated film obtained in Comp. Example 1.

FIG. 14 is a schematic diagram showing the construction of a plating apparatus 300 used in Comp. Example 1. The plating apparatus 300 shown in FIG. 14 includes a plating cell 310 for holding a plating solution Q, an anode 320 disposed in the plating cell 310, a resistor body 330 disposed above the anode 320, a substrate holder 360 for holding a substrate W with its surface W1 to be plated facing downwardly, and a seal 390 for shutting off those electric pathways between the anode 320 and the substrate W which do not run through the resistor body 330. Though not shown diagrammatically, the plating apparatus 300 also includes a plating solution supply section for supplying the plating solution Q into the plating cell 310 to immerse the resistor body 330 in the plating solution Q, a plating solution discharge section for discharging the plating solution Q over and under the resistor body 330, a plating solution circulation mechanism for circulating the plating solution Q, and a plating solution cooling mechanism for cooling the plating solution. The above-described porous body as the resistor body 330 and an insoluble anode as the anode 320 were used. The plating solution Q was prepared using copper sulfate, sulfuric acid, chlorine and an additive. A 300 mm-diameter silicon wafer having a 50 nm-thick copper seed layer was used as a substrate W. The substrate W was attached, with the surface W1 to be plated facing downwardly, to the substrate holder 360, as shown in FIG. 14. At that moment, the substrate W was outside the plating solution Q. The substrate W held by the substrate holder 360 was then lowered toward the plating solution Q, whose surface was in a horizontal state, and dipped into the plating solution Q. Plating was then carried out by supplying a plating current from a plating power source 370 so that a plated film having a thickness of 500 nm would be produced. The resulting plated film had a non-uniform thickness, as shown in FIG. 16, due to intrusion of air bubbles into the interface between the substrate W and the plating solution Q.

Comparative Example 2

Figure 16:
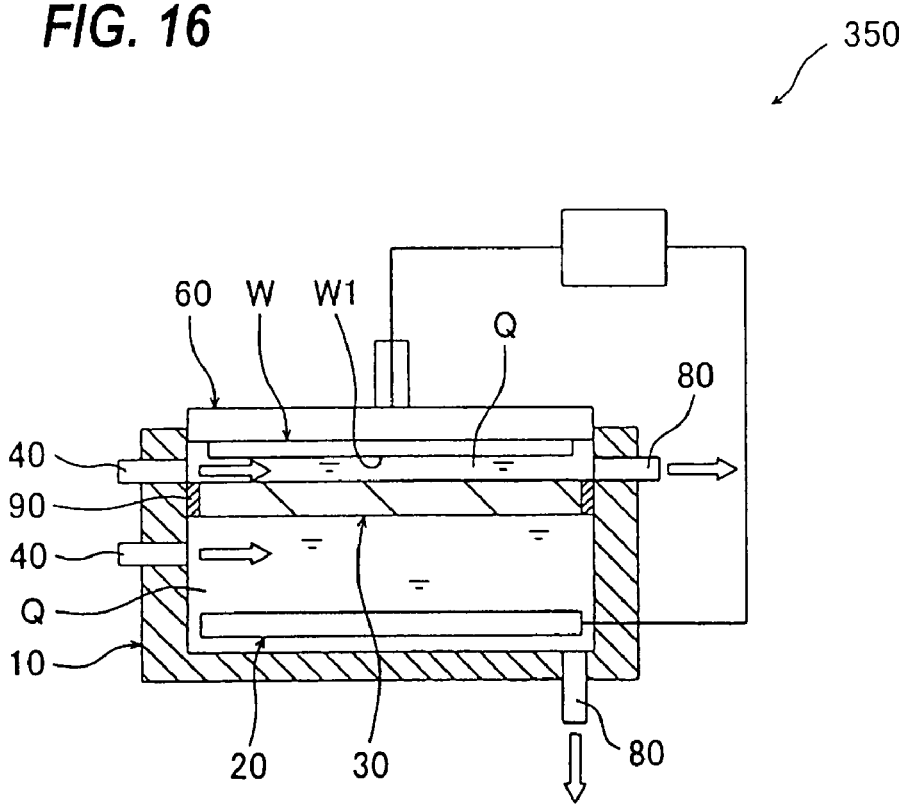
FIG. 16 is a schematic diagram showing the construction of a plating apparatus used in Comp. Example 2.

FIG. 16 is a schematic diagram showing the construction of a plating apparatus 350 used in Comp. Example 2. The plating apparatus 350 shown in FIG. 16 includes a plating cell 10 for holding a plating solution Q, an anode 20 disposed in the plating cell 10, a resistor body 30 disposed above the anode 20, plating solution supply pipes (plating solution supply section) 40 for supplying the plating solution Q into the plating cell 10 to immerse the resistor body 30 in the plating solution Q, plating solution discharge pipes (plating solution discharge section) 80 for discharging the plating solution Q over and under the resistor body 30, a substrate holder 60 for holding a substrate W with its surface W1 to be plated facing downwardly, and a seal 90 for shutting off those electric pathways between the anode 20 and the substrate W which do not run through the resistor body 30. The plating apparatus 350 also includes a not-shown plating solution circulation mechanism for circulating the plating solution Q and a not-shown plating solution cooling mechanism for cooling the plating solution.

Figure 17A:
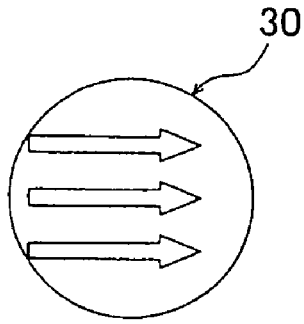
FIGS. 17A and 17B are diagrams illustrating different manners of allowing a plating solution to flow, as employed in Comp. Example 2.
Figure 17B:
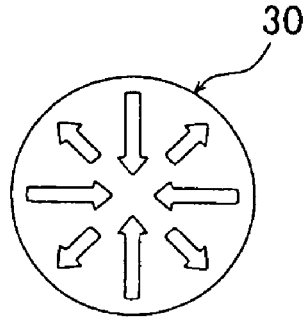
Figure 18:
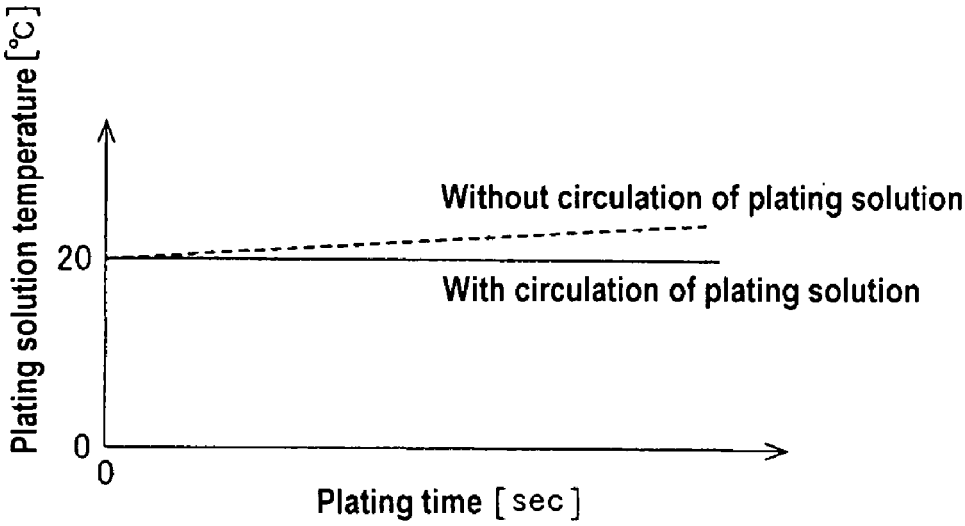
FIG. 18 is a diagram showing a change with time in the temperature of a plating solution with or without circulation of the plating solution.

A porous body as the resistor body 30 and an insoluble anode as the anode 20 were used. The plating solution Q was prepared using copper sulfate, sulfuric acid, chlorine and an additive. A 300 mm-diameter silicon wafer having a 50 nm-thick copper seed layer was used as a substrate W. The substrate W was attached, with the surface W1 to be plated facing downwardly, to the substrate holder 60, and dipped into the plating solution Q. Plating was carried out while independently circulating plating solutions Q by supplying the plating solutions Q, whose temperature were regulated at 20° C., from the plating solution supply pipes 40, 40 to above and below the resistor body 30 and recovering the plating solutions Q from the plating solution discharge pipes 80, 80. Plating operations were carried out in the following different manners of allowing the plating solution Q to flow over the resistor body 30: a manner in which the plating solution Q was allowed to flow in one direction along the upper surface of the resistor body 30, as shown in FIG. 17A; a manner in which the plating solution Q was allowed to flow toward the center of the resistor body 30, as shown in FIG. 17B; and a manner in which the plating solution Q was not circulated (the plating solution Q over the upper surface of the resistor body 30 was motionless). For each case, change with time in the temperature of the plating solution Q in the space between the substrate W and the resistor body 30 was measured. The results are shown in FIG. 18. As shown in the Figure, the temperature of the plating solution Q increased with time in the case of no circulation of the plating solution, whereas the temperature of the plating solution Q was kept constant in both the two manners of allowing the plating solution to flow and circulate.

The invention claimed is:

1. A plating method of plating a surface of a substrate, the method comprising:

providing a plating cell having an anode therein;

arranging a resistor body above the anode in the plating cell so as to form a space between a lower surface of the resistor body and the plating cell;

supplying a plating solution into the space formed between the lower surface of the resistor body and the plating cell so as to fill the space with the plating solution;

supplying a plating solution to an upper surface of the resistor body from a plurality of plating solution supply sections arranged around the resistor body, each of the plating solution supply sections being configured to discharge the plating solution toward a center of the resistor body such that a raised portion of the plating solution is created in the center of the resistor body;

lowering the substrate with the surface to be plated facing downwardly until a center of the surface to be plated initially comes into contact with the plating solution, and then a contact area between the surface to be plated and the plating solution broadens toward a periphery of the surface to be plated, and then a space between the surface to be plated and the upper surface of the resistor body becomes filled with the plating solution; and applying a voltage between the surface to be plated and the anode to plate the surface to be plated of the substrate.

2. The plating method according to claim 1, wherein said supplying the plating solution to the upper surface of the resistor body comprises supplying the plating solution at a flow velocity higher than a flow velocity of the plating solution supplied into the space between the lower surface of the resistor body and the plating cell.

3. The plating method according to claim 1, further comprising controlling a temperature of the plating solution by maintaining the temperature in a range of 20° C. to 28° C.

4. The plating method according to claim 1, wherein said lowering the substrate comprises lowering the substrate until a distance between the surface to be plated of the substrate and the upper surface of the resistor body is no larger than 5 mm.

5. The plating method according to claim 1, wherein said supplying the plating solution into the space formed between the lower surface of the resistor body and the plating cell and said supplying the plating solution to the upper surface of the resistor body are performed separately such that the plating solution supplied into the space and the plating solution supplied to the upper surface circulate independently.

6. The plating method according to claim 5, wherein said arranging the resistor body comprises providing a seal between the resistor body and the plating cell to shut off electrical pathways between the anode and the substrate which do not pass through the resistor body.

* * * * *